United States Patent [19]

Miyao

[11] 4,183,288

[45] Jan. 15, 1980

[54] STATIC PRESSURE THRUST BEARING

[75] Inventor: Takayuki Miyao, Hiratsuka, Japan

[73] Assignee: Aisin Seiki Kabushiki Kaisha, Aichi, Japan

[21] Appl. No.: 756,390

[22] Filed: Jan. 3, 1977

Related U.S. Application Data

[63] Continuation of Ser. No. 586,610, Jun. 13, 1975, abandoned.

[30] Foreign Application Priority Data

Jun. 13, 1974 [JP] Japan ..... 49-67450

[51] Int. Cl.[2] ..... F01B 13/06

[52] U.S. Cl. ..... 91/488; 308/9

[58] Field of Search ..... 91/488, 499, 489, 487

[56] References Cited

U.S. PATENT DOCUMENTS

| | | | |
|---|---|---|---|
| 2,155,455 | 4/1939 | Thoma | 308/9 |
| 3,004,180 | 10/1961 | Macks | 308/9 |
| 3,411,608 | 11/1968 | Thoma | 91/499 |
| 3,898,917 | 8/1975 | Adams et al. | 91/488 |

FOREIGN PATENT DOCUMENTS

| | | | |
|---|---|---|---|
| 2239745 | 2/1974 | Fed. Rep. of Germany | 91/487 |
| 767213 | 1/1957 | United Kingdom | 91/498 |
| 983310 | 1/1962 | United Kingdom | 91/488 |
| 1051632 | 12/1966 | United Kingdom | 91/489 |
| 1439536 | 6/1976 | United Kingdom | 91/488 |

*Primary Examiner*—William L. Freeh

*Attorney, Agent, or Firm*—Oblon, Fisher, Spivak, McClelland & Maier

[57] ABSTRACT

A static pressure thrust bearing includes a shoe member or a thrust axis provided with a static pressure pocket and a land for sealing the static pressure within the pocket, and a swash plate on a sliding surface provided with a slide surface upon which the shoe member is slidable. Lubricating oil flows through the shoe member and between the slide surface and the land surface, and each of the land and slide surfaces has a plurality of very small recesses so as to receive small particulates which may be within the lubricating oil. The difference of the static pressure occurring between the land surface and the slide surface alternately moves the small particulates originally disposed within one of the recesses thereof, into the other recesses as a result of the sliding movement of the shoe member whereby the small particulates are removed from the bearing by means of the lubricating oil.

3 Claims, 10 Drawing Figures

28
68
13
66
65
16
67
24
25
26
27
22
20
42
12
17
43
19
41
10
18
21
64
56
55
57
58
63
23
44
53
45
51
52
47
50
46
60
59
62
54
49
61
48
33
35
34
29
36
31
32
38
30
37
40
39

STATIC PRESSURE THRUST BEARING

This is a continuation of application Ser. No. 586,610, filed June 13, 1975 now abandoned.

BACKGROUND OF THE INVENTION

1. Field of the Invention

The present invention relates generally to thrust bearings, and more particularly to a static pressure thrust bearing interposed between a pump shoe and a swash plate of an axial piston type hydraulic pump and motor for use within vehicles.

2. Description of the Prior Art

Conventional axial piston type hydraulic pumps and motors comprise a revolving cylinder barrel having a plurality of parallel cylinders disposed therein and pistons slidably fitted within the cylinders and movable therein by means of a swash plate, each piston having a convex surface end which is swaged within a piston shoe having a peripheral land portion and a static pressure pocket. A smooth surface is usually provided upon the peripheral land portion so as to facilitate the sliding movement of the piston and cylinder apparatus over the surface of the swash plate.

Operating oil, which is also used as lubricating oil, passes axially through the pistons, and the static pockets provided within the piston shoes normally contain very small particulates, such as for example, metallic powder particles which are normally continuously being produced during operation of the movable parts, floating dust within the air and mixed into the lubricating oil, and the like. Accordingly, both the sliding surfaces of the peripheral land portion and the swash plate tend to be injured or scratched whereby gaps may be formed thereon during the operation of the pump motor. Lubricating oil leakage is then increased through the gaps and consequently the efficiency and durability of the hydraulic pump and motor substantially decreases due to the increase in friction between the sliding surfaces as a result of the lubricant loss, and consequently, the sliding surfaces between the peripheral land the swash plate become over-heated and excessively worn.

SUMMARY OF THE INVENTION

Accordingly, it is an object of the present invention to provide an improved static pressure thrust bearing for an axial piston type hydraulic pump and motor which can obtain high efficiency and durability of the hydraulic pump and motor.

Another object of the present invention is to provide an improved static pressure thrust bearing for an axial piston type hydraulic pump and motor which effectively prevents the sliding surfaces from becoming injured or scratched.

A further object of the present invention is to provide an improved static pressure thrust bearing for an axial piston type hydraulic pump and motor which comprises a piston shoe and swash plate having a plurality of small recesses formed therewithin.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF THE ILLUSTRATED EMBODIMENTS

Figure 1:
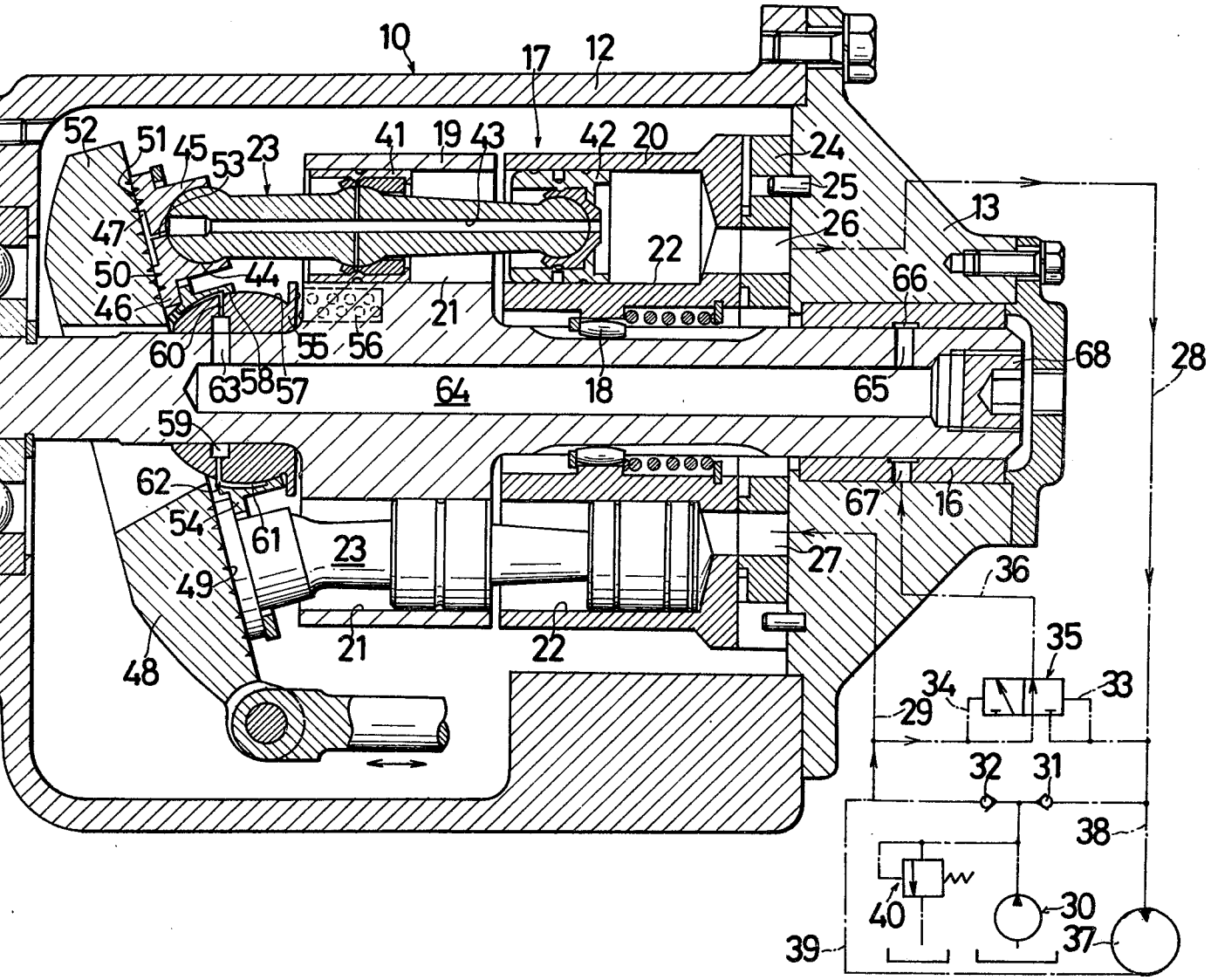
FIG. 1 is a longitudinal cross-section view of a hydraulic pump and motor constructed in accordance with the present invention and showing its cooperative parts.

Referring now to the drawings, and more particularly to FIG. 1 thereof, there is shown an axial piston type hydraulic pump and motor, generally indicated by reference numeral 10, which includes three casings 11, 12 and 13 serially connected together. A drive shaft 14 is supported within the casings by means of bearings 15 and 16, and is effective to transmit torque from a prime mover, not shown, to a cylinder barrel, generally indicated by the reference character 17, through means of a driving connection 18.

The cylinder barrel 17 is formed of two sections 19 and 20, cylinder barrel secion 19 being integral with the drive shaft 14 while cylinder barrel section 20 is rotatably and axially movable relative to and upon the drive shaft 14 through means of pins 18. Each of the sections 19 and 20 of the cylinder barrel 17 is provided with the same number of cylinders 21 and 22, and each of the cylinders 21 and 22 has a piston 23 axially slidable therein. A valve plate 24 is fixed to the casing 13 by means of pins 25 and two fluid ports or openings 26 and 27 are provided therewithin so as to communicate with fluidic conduits 28 and 29, respectively. Conduit 28 is fluidically connected to a charging pump 30 through means of a check valve 31, while conduit 29 is similarly connected to the charging pump 30 through means of a check valve 32, and a branched conduit 33, of conduit 28, and a branched conduit 34, of conduit 29, are connected to a change-over valve 35.

Conduit 28 is also connected to a conduit 38, which leads to a motor 37 having a load associated therewith, a conduit 39, and then to the conduit 29. Consequently, when the fluid pressure of conduit 33 is greater than thatof conduit 34, the change-over valve 35 is positioned as shown within FIG. 1, and the fluid of conduit 29 is fluidically connected to a conduit 36, while when the fluid pressure of conduit 34 is greater than that of conduit 33, the changeover valve 35 will be changed so as to fluidically connect conduit 28 with conduit 36. A regulator valve 40 regulates the fluid pressure transmitted from charging pump 30 and supplies such lower regulated pressure to either lower pressure side of conduits 28 and 29.

Each piston 23 has two piston heads 41 and 42 which are axially slidable within cylinders 21 and 22, respectively. The piston heads 41 and 42 form ball-and-socket joints with the piston rods of piston 23, and an axial passage 43 is provided within each piston 23 so as to be fluidically connected with the cylinder 22. Each piston 23 is also provided with a convex surface end 44 which is swaged within a piston shoe 45 a the left end thereof, as viewed within FIG. 1, and the piston shoe 45 is seen to include a peripheral land portion 46 and a static pressure pocket 47 defined therewithin. A swash plate 48 is mounted upon the drive shaft 14 and is arranged to slide upon the peripheral land portion 46 of piston shoe 45.

Figure 2:
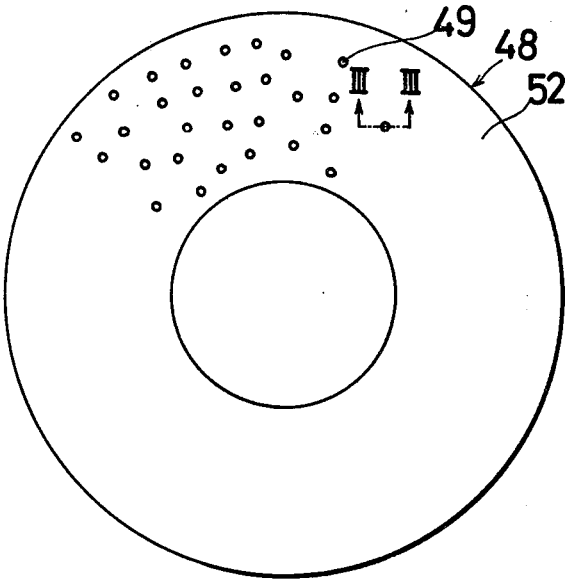
FIG. 2 is a front elevational view of a swash plate which may be utilized within the pump and motor shown within FIG. 1.
Figure 3:
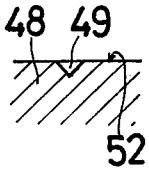
FIG. 3 is a partial cross-section view of the swash plate of FIG. 2 taken along line III—III of FIG. 2.
Figure 5:
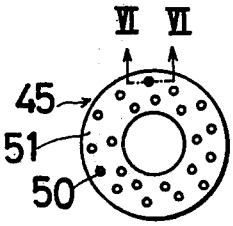
FIG. 5 is a front elevational view of a piston shoe which may be utilized within the pump and motor shown within FIG. 1.
Figure 6:
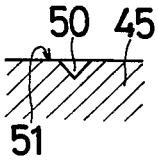
FIG. 6 is a partial cross-section view of the shoe of FIG. 5 taken along line VI—VI of FIG. 5.

The static pressure pocket 47 is fluidically connected to the cylinder 22 through means of the axial passage 43 and an elongated orifice 53 so as to thereby provide lubrication for the slide surfaces 51 and 52 between the piston shoe 45 and the swash plate 48, respectively. Upon swash plate 48, there is formed a plurality of small conical recesses 49, and as shown within FIGS. 2 and 3, all are circular in cross-section taken along a plane parallel to surface 52. Similarly, upon land 46 of piston shoe 45, there is formed a plurality of small recesses 50, as shown within FIGS. 5 and 6, having the same configuration as those of recesses 49.

Figure 4:
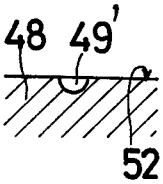
FIG. 4 is a view similar to that of FIG. 3, showing however another embodiment of the swash plate.
Figure 7:
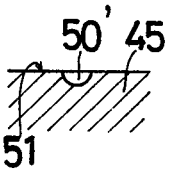
FIG. 7 is a view similar to that of FIG. 6, showing however another embodiment of the piston shoe.

Each of the small recesses has a relatively large opening within the surface of the shoe or swash plate and the diameter of the recess, as formed, is gradually reduced as one proceeds away from the shoe and plate surfaces. Therefore, small particulates mixed within the lubricating oil will be easily received therein and vented therefrom. Within the embodiments of FIGS. 4 and 7, there is shown another embodiment of the recesses 49' and 50' of the swash plate 48 and the piston shoe 45, and it is seen that the cross-section of the recesses 49' and 50' are formed in the configuration of a semi-circle.

A shoe retainer 54 serves to retain the end portion of piston 23 seated within the piston shoe 45, and the shoe retainer 54 and shoe 45 are in turn held in contact with each other along the surfaces thereof by means of a retainer 55 axially urged thereagainst by means of a plurality of springs 56 disposed within shaft 14. The retainer 55 is axially movably mounted upon the drive shaft 14, and the same is accommodated within a concave surface 58 of the shoe retainer 54, it being additionally noted that the retainer 55 is not movable in the radial direction as a result of splines or keys not shown.

An annular groove 59 is provided at the inner periphery of the retainer 55 and the groove 59 is fluidically connected to radially extending passages 60 within retainer 55 and to a peripheral groove 61 provided witihin shoe retainer 54. An aperture 62 communicates with groove 61 for providing lubricating fluid to each surface of the shoe and the swash plate and it is also seen that the groove 59 is fluidically communicated with conduit 36 through means of a radial passage 63 within shaft 14 at the left end thereof, an axial passage 64 within shaft 14, a radial passage 65 of the driving shaft 14 at the right end thereof, and a peripheral groove 66 and a radial passage 67 provided within bearing 16. A plug 68 is threaded within the right end of the driving shaft so as to seal the same and prevent any leakage from the axial passage 64.

In operation, the hydraulic pump and motor functions as a pump in the well-known manner when the drive shaft 14 is driven by means of a suitable prime mover, and a result, the cylinder barrels 19 and 20 are rotated by means of the drive shaft 14. When the swash plate 48 is positioned as shown within FIG. 1, the pistons 23 will reciprocate within cylinders 21 and 22 in the axial direction as a result of the movement of piston shoe 46, and consequently, fluid is sucked into port or opening 27 and discharged into conduit 28 through means of port or opening 26. At this time, the discharging fluid within cylinder 22 communicates with the slide surfaces 51 and 52 between the piston shoe 45, and more particularly the land 46, and the swash plate 48, so as to thereby slightly float shoe 45 upon a film of lubricant upon swash plate 48 and thus lubricate the surfaces thereof.

Figure 8:
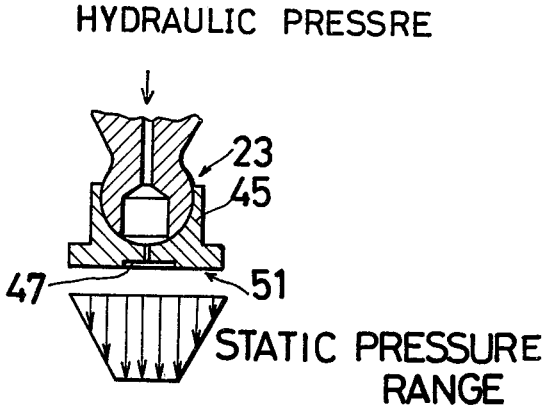
FIG. 8 is a schematic diagram of the static pressure range associated within the piston shoe.

The static pressure range existing within the static pressure pocket 47 of piston shoe 46 is generally shown within FIG. 8, and it will be understood that a static pressure is always exerted upon land 46, and that the static pressure associated with the central portion of the shoe 45 is greater than that of the peripheral portion thereof.

Figure 9:
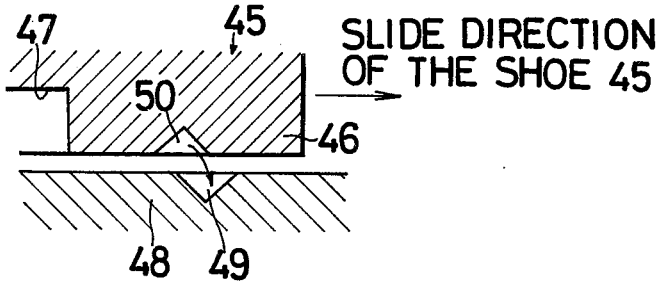
FIG. 9 is a partial cross-section view of the piston shoe and swash plate of the present invention.

As can be seen from FIG. 9, in accordance with the present invention, even if the small particulates are caught within the recesses defined between the slide surfaces of the land 46 and the swash plate 48 such as for example, if the particulates are caught within a recess 50 of the land 46, they are easily moved into one of the recesses 49 of swash plate 48 by means of the static pressure difference existing between recesses 49 and 50 upon the rotational movement of piston shoe 45. The particulates within the recesses 49 of swash plate 48 are then able to be washed away by means of the lubricating oil being supplied from the aperture 62 after the piston shoe 45 has moved away from or relative to the swash plate 48.

Figure 10:
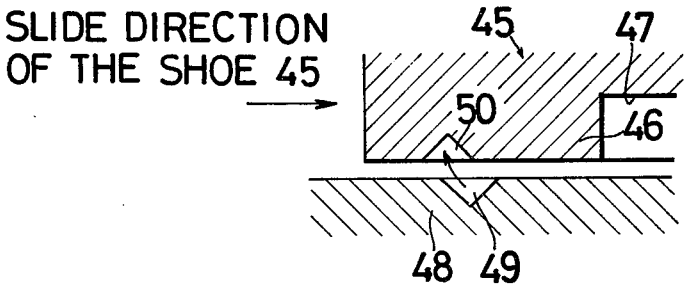
FIG. 10 is a view similar to that of FIG. 9, showing however the relative positions of the components during a different portion of the operative cycle.

Similarly referring to FIG. 10, within the trailing land 45, the particulates within recess 49 will be moved into recess 50 of piston shoe 45, however, after the piston shoe 45 has rotated approximately 180°, the trailing land 45, with the particulates, will be disposed as shown within FIG. 9. Thereafter, the particulates within the trailing land 45 will be moved into the recesses of the swash plate 48, as mentioned hereinabove.

Obviously, many modifications and variations of the present invention are possible in light of the above teachings. It is to be understood therefore that within the scope of the appended claims, the present invention may be practiced otherwise than as specifically described herein.

What is claimed as new and desired to be secured by Letters Patent of the United States is:

1. A static pressure thrust bearing, comprising:

means for supplying lubricating oil containing particulates;

a first annular member having a flat sliding surface;

a second member, having an orifice connected to said supply means, comprising an axial thrust means, including a central static pressure pocket and a peripheral land surface disposed about said pocket for sealing said static pressure within said pocket, and being slidable upon said flat sliding surface; and a plurality of recesses, formed within, and distributed throughout, both said annular flat sliding surface of said first member and said peripheral land surface of said second member in a random manner, for receiving particulates mixed within lubricating oil during the operation of said bearing, each of said recesses formed within and distributed thoughout said annular flat sliding surface being circular in cross-section taken along a plane parallel to said annular flat sliding surface, said diametrical extent of said recesses gradually decreasing in the direction extending away from said surface, and the number of said recesses within both said first and second members being sufficiently large so as to densly pack said recesses within the surfaces of said members and thereby provide a continuous fluidic interchange process of said lubricating oil between said peripheral land area of said second member also being physically separated from said central pocket so as to establish a pressure differential therebetween, such that the static pressure difference between said central pocket and said peripheral land area and the cooperation of said recesses causes said particulates to move radially from said central pocket to said peripheral land area and from said recesses of said peripheral land area to said recesses of said flat sliding surface by simultaneous radial communication of said recesses during operation of said thrust bearing.

2. A static pressure thrust bearing as set forth in claim 1, wherein:

said sliding surface is formed upon a swash plate; and said axial thrust means further comprises a piston shoe connected to a piston, and a cylinder barrel having cylinder means therein, said piston being slidably fitted within said cylinder means.

3. A static pressure thrust bearing as set forth in claim 2, wherein:

each recess has a relatively large diametrical opening adjacent said surfaces of said swash plate and said piston shoe.

* * * * *